United States Patent [19]

Weisner et al.

[11] Patent Number: 4,649,680

[45] Date of Patent: Mar. 17, 1987

[54] STANDING SEAM ROOF SKYLIGHT

[75] Inventors: Kent A. Weisner, Maitland; Lester L. Walls, Jr., Deltona, both of Fla.

[73] Assignee: Kenergy Corporation, Orlando, Fla.

[21] Appl. No.: 700,106

[22] Filed: Feb. 11, 1985

[51] Int. Cl.[4] ..... E04B 7/18

[52] U.S. Cl. ..... 52/200; 52/581; 52/588

[58] Field of Search ..... 52/200, 58, 208, 581, 52/584, 588, 716, 199, 18, 518, 543, 395, 466

[56] References Cited

U.S. PATENT DOCUMENTS 4,117,638 10/1978 Kidd, Jr. et al. ..... 52/200

FOREIGN PATENT DOCUMENTS 209300 11/1966 Sweden ..... 52/200

OTHER PUBLICATIONS

"P/A Products", Progressive Architecture, Mar. 1955, p. 163.

"Danpalon—An Irresistible Idea", Poligal U.S.A., Inc., 2-11-1985.

*Primary Examiner*—Carl D. Friedman

*Assistant Examiner*—Naoko N. Slack

*Attorney, Agent, or Firm*—Macdonald J. Wiggins

[57] ABSTRACT

A skylight system for standing seam metal roofs, shingle roofs and sun roofs in which sheet plastic skylights having upstanding edges are provided. In one embodiment, a skylight is installed in a roof formed from metal standing seam panels. In another embodiment, a skylight is installed in an opening in a shingle roof in which step flashing is used to form a standing seam with the skylight upstanding edges and a watertight joint with the roof shingles. Another embodiment utilizes the skylights in which the flat edges are formed by folding over to make lateral joints between adjacent skylights while longitudinal joints are formed by abutting the upstanding edges to thereby produce a sun roof.

9 Claims, 20 Drawing Figures

STANDING SEAM ROOF SKYLIGHT

BACKGROUND OF THE INVENTION

1. Field of the Invention

The present invention relates to skylight systems for standing seam roofs, shingle roofs and sun rooms, and more particularly to a skylight systems providing simple and leakproof installation thereof.

2. Description of the Prior Art

The use of skylights in residences as well as commercial buildings has become widespread in recent years with the advent of low cost and rugged plastic dome skylights. Self flashing plastic skylights are popular, partly due to economies in eliminating extensive curb construction. However, some skill is required if a leakproof installation is to be achieved and some customer dissatisfaction has occurred from poor installation practices.

Certain types of roofs have not been suitable for skylight installation. For example, it is common in the southern parts of the United States to construct patios, porches and the like using sheet metal standing seam roofing. A typical roof of this type utilizes long panels having upturned edges. The panels are laid side by side with the upstanding edge of one panel contiguous with the upstanding edge of adjacent panels. The upper edges of the upstanding portions may be bent at right angles or rolled. In either style, an interlocking bead is provided which snaps over the contiguous upstanding portions of the panels. This type of roof also is widely used for metal industrial buildings.

Although it is desirable in many installations to install skylights in a standing seam roof, difficulty has been experienced in adapting standard plastic dome type skylights to the standing seam metal roofs. Self flashing skylights have been used which must be screwed to the metal and require caulking compound to prevent leaking. However, due to the differing expansion coefficients of the plastic and sheet metal, it has been found very difficult to prevent leaks. Furthermore, openings must be cut into the metal which reduces the strength of the roof and adds to the labor cost.

There have been attempts to overcome these problems. For example, it is known to form a narrow continuous panel of acrylic plastic or the like which will simply replace a standard metal roof panel and which runs the entire length of the roof. It is apparent that this type of unit must be narrower than a standard roof panel since the plastic lacks the required strength for a full width panel.

Problems have also arisen in installing self flashing plastic skylights in shingled roofs and care must be taken to ensure freedom from leaks. This problem is compounded when a so-called sunroof, formed by joining a plurality of plastic skylights together, is desired.

There is a need for a plastic dome type skylight which can be installed at any point along a metal roof panel without cutting an opening in the metal panel, which will not experience difficulties with leakage and which can be installed in a shingled roof with the same watertight integrity that is obtainable with curb type installations. Additionally, there is a need for a self flashed skylight which can be interlocked with others to form a leakproof sunroof.

SUMMARY OF THE INVENTION

The present invention includes a plastic skylight formed form acrylic sheet, CAB plastic sheet, polycarbonate sheet or the like having a conventional skylight dome formed therein and a self flashing flange which may be installed in a metal standing seam roof. The skylight is formed to have the same width as a standard metal roof panel. The side flanges are bent upward to the same height as the metal roofing standing seam and the end edge flanges are formed in the same manner as those of the metal roofing panels. The width of the skylight is the same as that of the metal roof panels. As may now be understood, the upstanding edges of the skylight of the invention will mate with the adjacent upstanding edges of the metal panels of the roof. A standard metal seam clip and batten are utilized and are clamped over the standing seam. Other types of upper edges such as a rolled edge can also be provided to be usable with other roof seam designs. A flange is provided at each end of the dome of the skylight which is formed to overlap the ends of metal roof panels in the same run with the skylight. The skylight flanges are formed to make a snug fit with a metal panel roof panel. The joint between the skylight and the adjacent panels in the same run may be sealed with any suitable compound. Preferably, a flat plastic sheet is bonded to a lower perimeter of the skylight dome so as to provide a dead air space for insulation properties. In an alternative embodiment, an inverted dome may be bonded to the flat sheet thereby providing two insulating air spaces.

Some seam roofs have a flat upstanding seam. One implementation of the invention is formed by folding a flat self flashing flange of an all plastic skylight up at 90° to fit against a flat seam of a metal roof panel. A snap on seam cap is installed over the plastic to metal seam.

The flat seam version of the invention is suitable for installation on a shingled roof using step flashing coupled to the upstanding seam by a seam cap. The step flashing solves the leakage problem experienced with prior art self flashing plastic skylights.

In another embodiment of the invention used for forming sloping sunroofs, an upstanding flat seam is provided along the sides of a plastic skylight. The upper and lower edges are formed by folding the lower edge and under the upper edge over, thereby producing means for interlocking similarly formed skylights. A sun roof can be produced by mounting a multiplicity of such skylights with the lateral edges coupled by seam caps and the folded edges by forming interlocking joints. A grid of extruded metal rafters and purlins can be used to support the skylights which have suitable metal seam clips and C-clips to secure the skylight edges and joints to the grid. Sealants are applied at all joints to prevent leaking.

As will be understood, the provision of the above plastic skylights will permit fast and accurate assembly and installation of skylights and sunroofs by relatively unskilled workers, and will provide leakproof joints with the roof.

It is therefore a principal object of the invention to provide a dome type plastic skylight which can be installed in a metal roof of the upstanding seam type.

It is another object of the invention to provide such a skylight in which the upstanding seam flanges mate on a variety of roofs quickly and which will provide a relatively leakproof installation.

It is still another object of the invention to provide a skylight for use in metal upstanding seam roofs.

It is yet another object of the invention to provide a plastic self flashing skylight which can be installed on a shingled roof and coupled to the shingle portion thereof by means of step flashing.

It is a further object of the invention to provide a plastic skylight having edge joints that can be interlocked to form a sun roof of multiple skylights.

These and other objects and advantages of the invention will become apparent from the following detailed description when read in conjunction with the drawings.

BRIEF DESCRIPTION OF THE DRAWINGS

FIG. 8 is a perspective view of a skylight in accordance with the invention for use on shingled roofs and the like;

DETAILED DESCRIPTION OF THE PREFERRED EMBODIMENT

Figure 1:
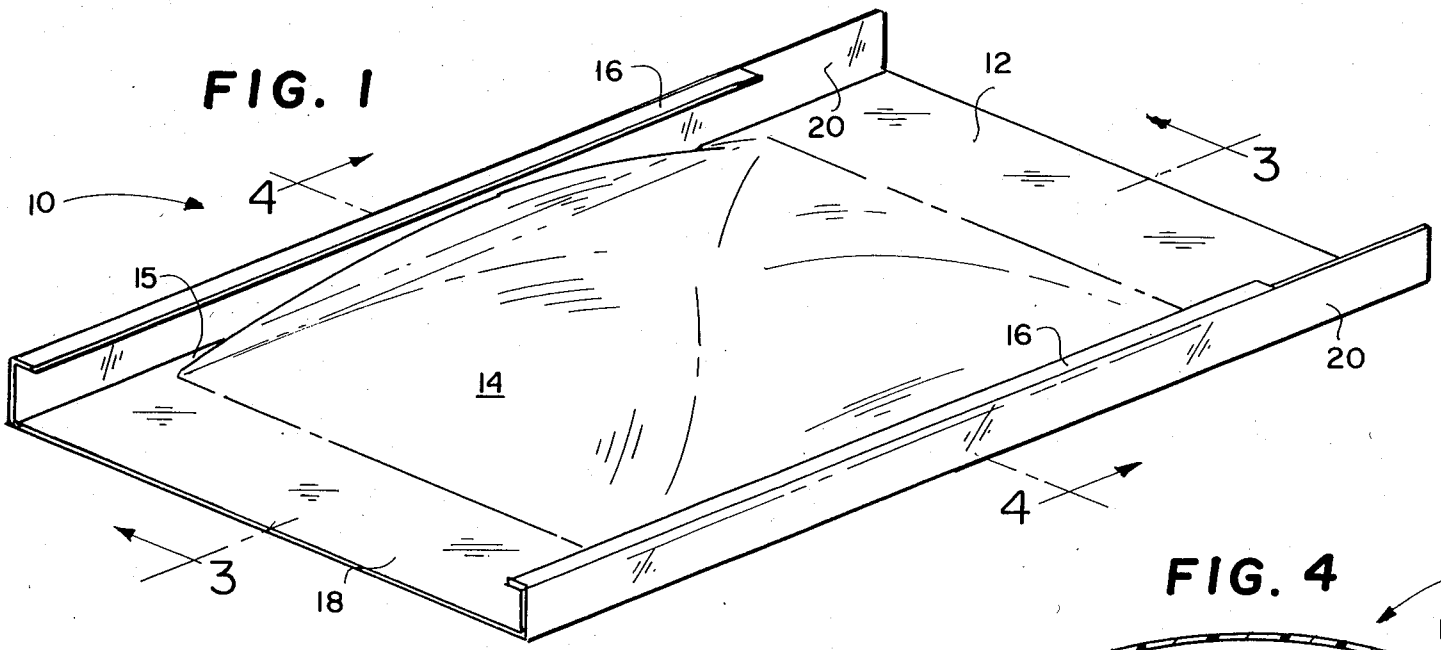
FIG. 1 is a perspective view of a typical skylight dome in accordance with the invention.

The present invention is an improved all plastic skylight design that is applicable to several types of roof structures. In one embodiment of the invention, a plastic dome type sky light is provided for use with metal standing seam roof panels. Standing seam roof panels of metal are generally found in a rectangular shape having a flat or corrugated roof section with standing seam portions bent upward at 90° along each longitudinal edge. The standing seam height may be on the order of two inches. Various designs of the standing seam are available. In FIG. 1, one embodiment of the invention is shown for use with metal standing seam roof panels in which the top edge of the standing seam is bent inward at 90° and a seam is formed by a batten cap disposed over the abutting standing seam. Thus, the skylight 10 shown in FIG. 1 has longitudinal-edge upstanding seams 20 with a folded-over edge 16 to match the metal standing seam roof panel with which the sky light 10 will be used. It is to be understood that other standing seam designs may also be applied to the skylight 10 to match the particular metal standing roof panel. This implementation of the invention will be disclosed with reference to the right angle edge 16 as shown. Plastic sky light 10 may be made of any suitable plastic sheet; however, a preferred material is polycarbonate sheet such as General Electric Lexan®. A dome or bubble 14 is formed in the center of the plastic sheet leaving a flat portion 18 at one end and a flat portion 12 at the opposite end. Preferably, a trough area 15 is provided between seam 20 and dome 14 to insure water drainage.

Figure 3:
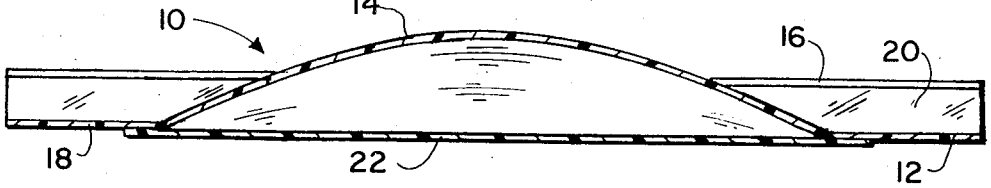
FIG. 3 is a cross-sectional view of the skylight of FIG. 1 through the plane 3—3.
Figure 2:
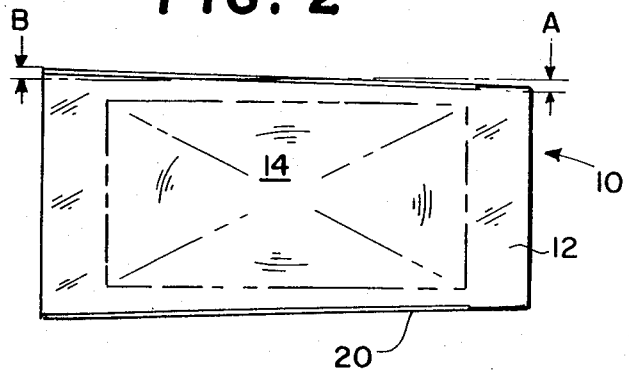
FIG. 2 is a top view of the dome skylight of FIG. 1.

In FIG. 2, a design feature of skylight element 10 is indicated. As shown in somewhat exaggerated form, the seam portions 20 are not parallel but taper slightly longitudinally. This produces a spacing A at one end of skylight 10 and a spacing B at the opposite end with respect to parallel edges of metal roof panels. This deviation from a straight line may be on the order of ⅛ inch. This permits the narrow end 12 to be inserted between the upstanding seams of an abutting metal standing seam panel and the end of the abutting steel panel at the opposite end will slide inside of wide end 18. As will now be recognized, dimensions A and B need only be approximately the thickness of the sheet metal of the metal roof panels. A cross section of the skylight 10 of FIG. 1 through the plane 3—3 is shown in FIG. 3. Although a single dome skylight 10 may be utilized, it is preferable to add a rectangular plastic sheet 22 bonded to the edges of dome 14. Plastic sheet 22 serves two purposes: it adds additional strength to the dome; and it provides a dead air space for insulation purposes.

Figure 4:
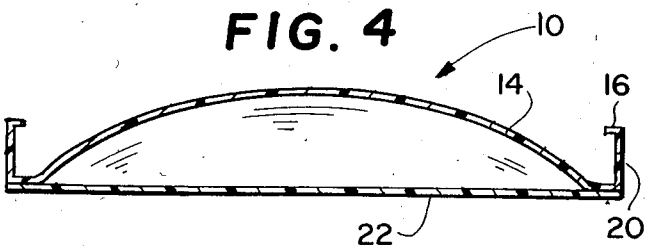
FIG. 4 is a cross-sectional view of a double skylight similar to that of FIG. 1.
Figure 5:
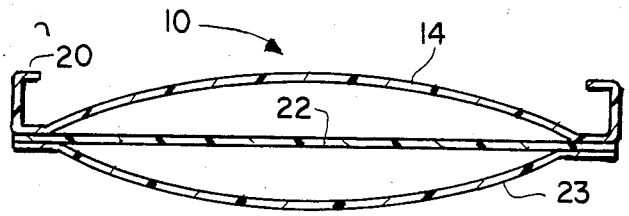
FIG. 5 is a cross-sectional view of a triple skylight similar to that of FIG. 1.

Another advantageous construction is shown in the cross-sectional view of a double air space skylight of FIG. 5. The skylight in accordance with FIGS. 3 and 4 has an inverted plastic dome 23 bonded to the edges of plastic sheet 22 thus forming two dead air spaces for additional insulation.

Figure 6:
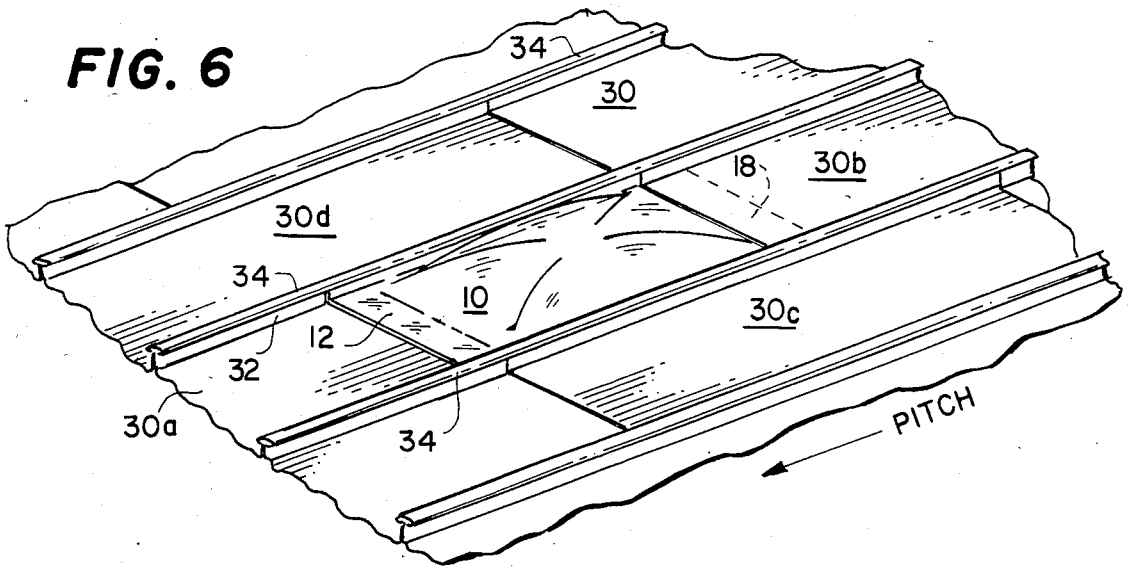
FIG. 6 shows a fragmentary perspective view of a metal roof system having a skylight in accordance with the invention installed therein.
Figure 7:
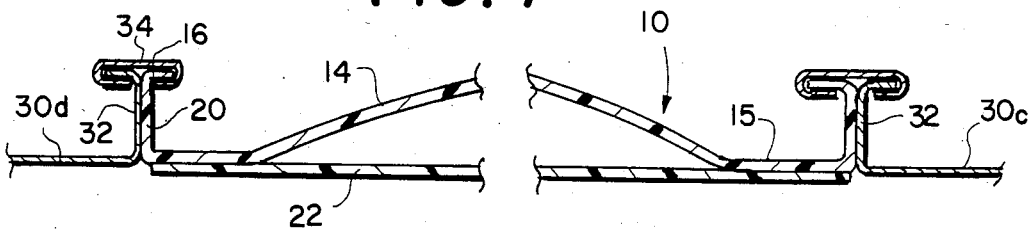
FIG. 7 is a cross sectional view of the skylight of FIG. 1 in cross section showing the manner of joining to two adjacent metal panels.

A typical installation is shown in FIG. 6. Here, a roof structure is shown utilizing metal standing seam panels 30 having standing seams 32. As may be noted, metal panels 30 are secured together by a batten strip 34 best seen in cross section in FIG. 7. Normally, a sealant is applied to the mating surfaces of standing seams 32 and 30 and may also be applied to the inside of batten strip 34 before installing. Batten strip 34 is crimped about the edges formed in standing seams 32 and 20.

In FIG. 6, a skylight 10 in accordance with the invention has been installed between metal roof panels 30A and 30B and adjacent metal roof panels 30C and 30D. As best noted in the cross sectional view through skylight 10 and roof panels 30C and 30D of FIG. 7, batten strip 34 is crimped around skylight standing seam 20 and metal roof panel standing seam 32. Sealant may be applied between the seams 20 and 32 prior to installation. End 12 of skylight 10 has been inserted between standing seams 32 of roof panel 30A at the lower end while, at the upper end 18, the lower end of panel 30B has been inserted between standing seams 20. Sealant is placed across the entire length of the flat seam formed at both the upper and lower edges. The installation is made such that the pitch of the roof is as shown by the arrow.

As may be recognized, skylight 10 can be the full width of a metal roof panel 30 and may be installed at any place in the roof desired. Similarly, the length of skylight 10 may be selected in accordance with the amount of exposure desired.

Figure 8:
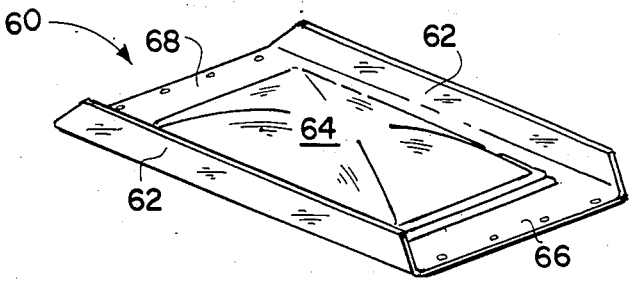

An embodiment of the invention which is suitable for use in shingled roofs, either during new construction or in modification of existing roofs, is shown in FIG. 8. Skylight 60 is formed from sheet plastic having a dome 64 and upper and lower edges 61 and 66. The longitudinal edges are bent up at 90° to form straight standing seams 62. As will be explained hereafter, it is desirable to cut the corners of seams 62 at an angle as shown.

Figure 9:
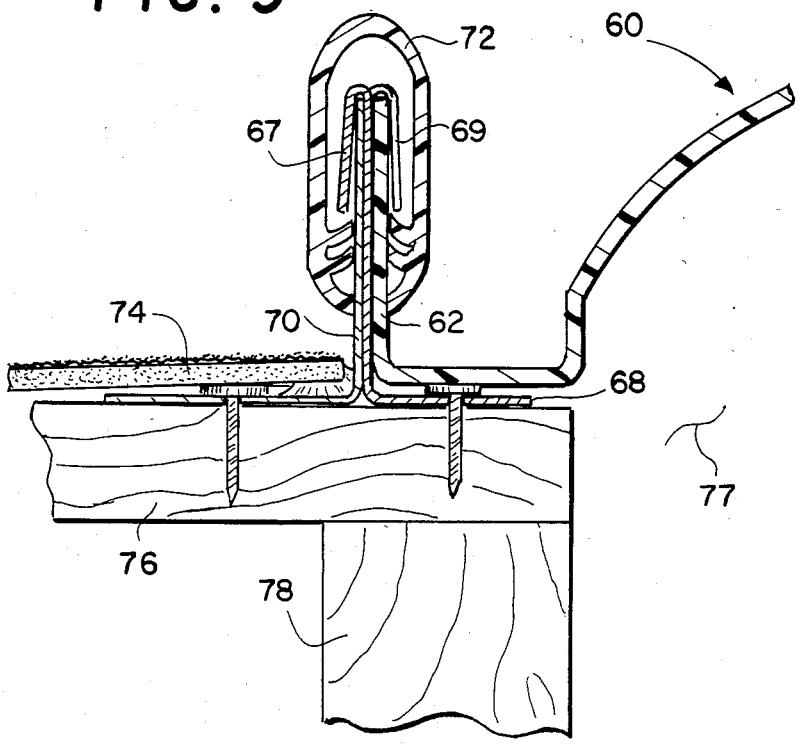
FIG. 9 is a partial cross sectional view of a skylight of FIG. 6 installed on a shingled roof.
Figure 19:
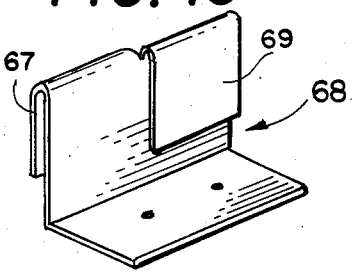
FIG. 19 is a perspective view of an anchor clip utilized with the standing edge seams of the skylights of a sunroof of FIG. 12.

The method of installation of skylight 60 is shown in the partial cross sectional view of FIG. 9. Here a rafter or truss element 78 is shown supporting roof sheathing 76. A space indicated at 77 is left which is open to the interior of the building over which the skylight dome will be installed. The skylight is held in place by a plurality of anchor clips 68 shown in more detail in the perspective view of FIG. 19. Anchor clips are nailed to sheathing 76 and spaced along the skylight seams 62. As may be noted, one clip end 69 is folded over standing seam 62. A plurality of step flashing elements 70 having the same height as standing seam 62 are abutted to standing seam 62 and anchor clips 68. One clip end 67 in each anchor clip 68 is folded over an adjacent step flashing 70. Step flashing 70 is nailed to roof sheathing 76 beneath roofing 74 and over roofing felt 75. As is well known in the art, the step flashing is suitably overlapped to prevent water leakage. After installation of the skylight 60, anchor clips 68 and step flashing 70, the standing seam is covered with a seam cover or batten 72. This batten may be formed of sheet metal and crimped over the standing seam, in which instance sealant is used to insure a water tight seam. However, it is preferred to use a snap on seam having an extruded vinyl weather seal such as is available from Berridge Manufacturing Company. This snap on seam device presents an attractive appearance and forms a weathertight seal.

Figure 10:
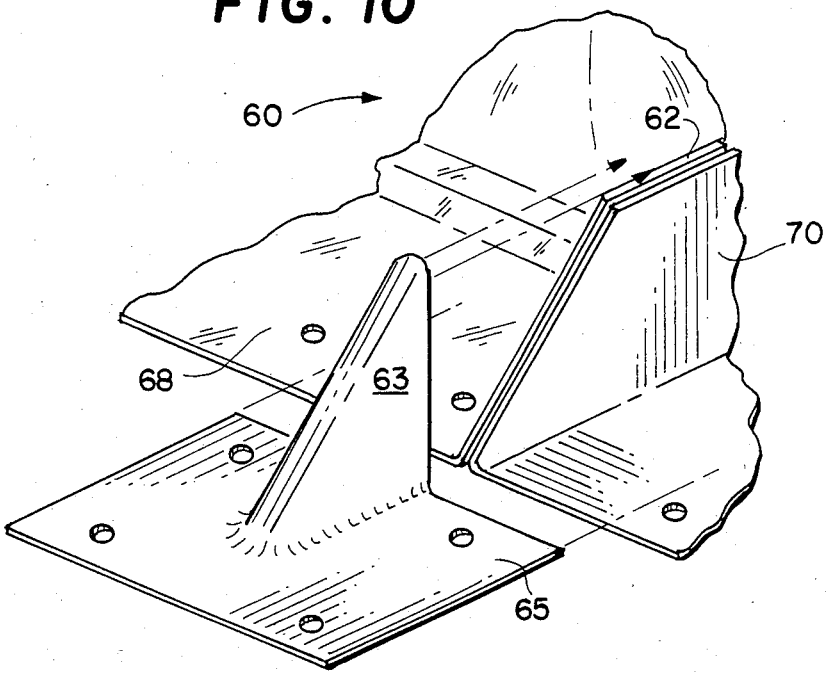
FIG. 10 is a perspective view of a shroud showing the manner of installing on the skylight of FIG. 9.

At the upper and lower ends of skylight 60, skylight ends 66 and 61 are nailed to the roof sheathing in conventional fashion. To prevent leakage at the ends of the standing seams, a shroud 65 seen in FIG. 10 is provided. Shroud 65 may be formed from sheet metal or the like. An angular recess 63 is formed which matches the ends of skylight standing seams 62. The step flashing 70 is trimmed to match this angle and shroud 65 is placed over flashing 70 and standing seam 62. It is then nailed to the roof sheathing. Thereafter, snap on seam cover 72 is installed on seams 62 and 70 producing a watertight seam.

As will now be recognized, this embodiment of the invention permits a low cost and watertight installation of a skylight in either an existing roof or in new construction without the time, labor and materials required to construct a curb in the roof opening for a curb type skylight. It also eliminates the problems heretofore found with self flashing skylights due to separation and cracking of sealant after exposure to the weather and provides a desirable low profile skylight.

Figure 11:
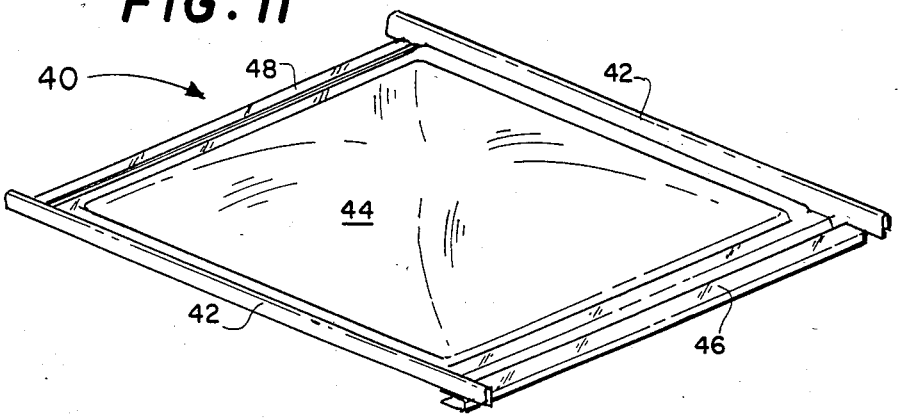
FIG. 11 is a perspective view of a skylight in accordance with the invention that is suitable for forming sunroofs.
Figure 12:
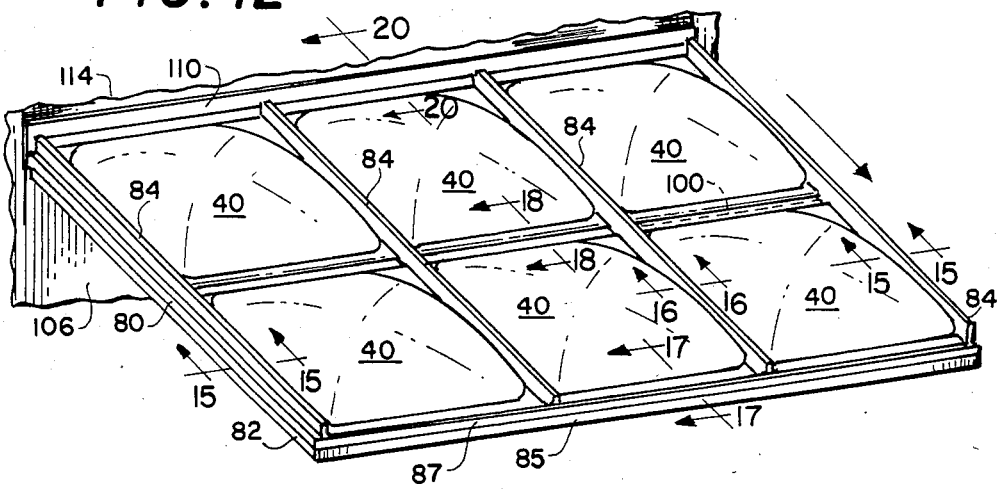
FIG. 12 is a typical sunroof shown in perspective view using the skylights of FIG. 11.
Figure 13:
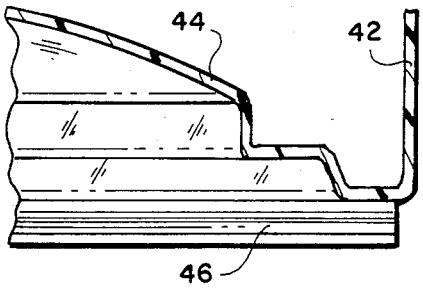
FIG. 13 is a partial cross sectional view of the skylight of FIG. 11 showing a standing seam thereof.
Figure 14:
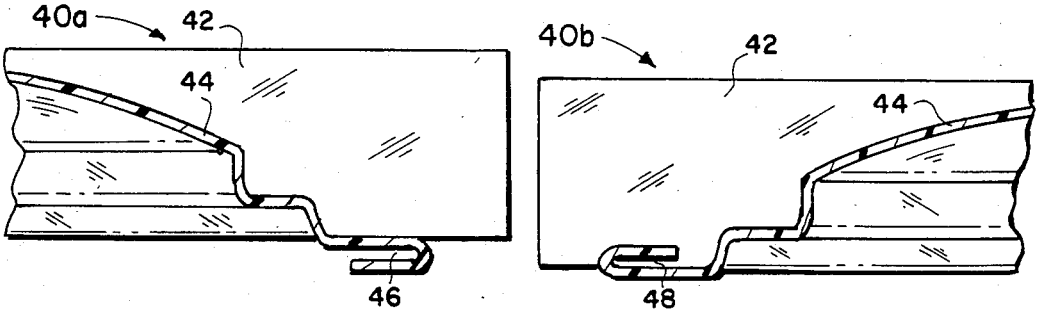
FIG. 14 shows in partial view the ends of the skylight of FIG. 11.

A third embodiment of the invention is shown in FIG. 11 in which a skylight 40 is provided having standing seam edges 42 similar to that of skylight 60 of FIG. 8. However, the lower edge 46 and upper edge 48 are formed such that these edges of adjacent skylights 40 can be joined together. Thus, skylight 40 is usable to form sun roofs as will be described hereinafter. For example, a typical sun roof is shown in FIG. 12 formed from six skylights 40. The sun roof of FIG. 12 has a pitch as indicated in the direction of the arrow. To permit the upper edge of one skylight 40 to be joined to the lower edge of another skylight 40, these edges are formed as indicated in FIG. 14. Here, the lower edge of skylight 40A is shown which is formed by folding the edge 46 under itself to form a narrow first U shaped edge. Similarly, lower skylight 40B has its upper edge 48 folded over itself to form a narrow second U shaped edge. As will be noted, edge 46 may be interlocked with edge 48 in a manner as will be described below. FIG. 13 shows the cross section through plane 13—13 in FIG. 11 illustrating the standing seam edge 42.

Figure 15:
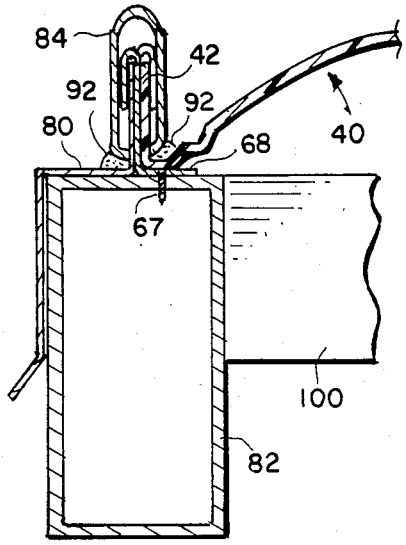
FIG. 15 shows a cross sectional view of a perimeter rafter of the sunroof of FIG. 12 showing in partial view the installation of the standing seam edge of the skylight thereof.

A sunroof as shown in FIG. 12 can be formed with multiple skylights 40 mounted on a rafter and purlin system. A side perimeter rafter 82 is shown with the system having a similar rafter along the opposite side, a front perimeter rafter 85, and a pair of interior rafters 83, not seen in this view. Purlins 100, seen in phantom view, run between the rafters 82 and 83. Details of the joints between the skylights 40 and the manner of connecting the skylights to the rafters and purlins are shown in FIGS. 15 through 18. FIG. 15 shows a cross-section through plane 15—15 of FIG. 12. Although the rafters and purlins may be of wood or other material, it is preferred to use rectangular extruded aluminum tubing. In FIG. 15, a side perimeter rafter 82 is seen having an anchor clip 68 fastened to rafter 82 by screws 67. Flashing 80 is butted with side seam 42 of skylight 40 and the upper clip ends of anchor clip 68 are bent over the skylight standing seam and the flashing 80 to hold these elements securely in place. Sealant is applied to this seam prior to assembling. A seam cover 84 is then placed over the seam and sealant 92 installed to insure against leakage. As will be understood, anchor clip 68 may be installed every foot or so along the seam.

Figure 16:
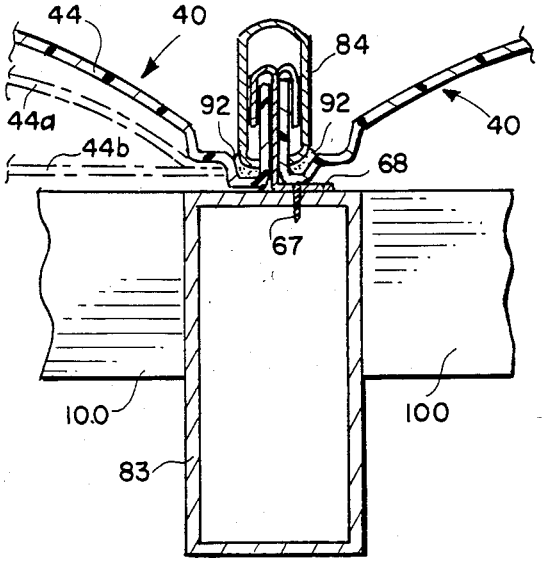
FIG. 16 is a cross sectional view of an interior rafter of the sunroof of FIG. 12 showing partially two abutting standing seams of the skylight of FIG. 11.

In FIG. 16, the standing seam between two adjacent skylights is shown in cross-section through plane 16—16 of FIG. 12. An interior rafter 83 has anchor clips 68 fastened to it by screws 67. Anchor clips 68 are bent over standing seams 42 of the adjacent skylights and a seam cover 84 installed with sealant 92.

Figure 17:
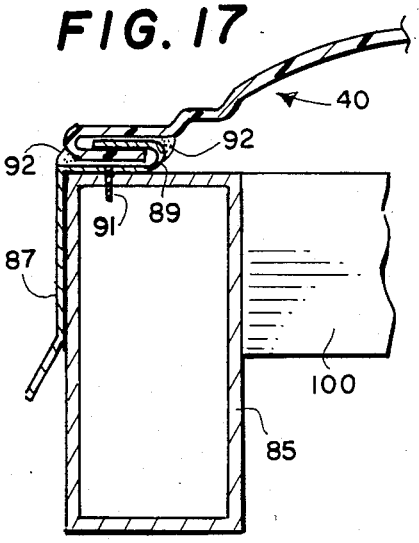
FIG. 17 is a cross sectional view of the front perimeter rafter of the sunroof of FIG. 12 showing the manner of attaching the skylight end thereto.
Figure 18:
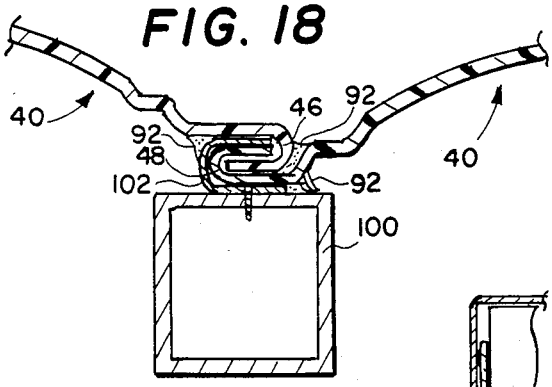
FIG. 18 is a cross sectional view through a purlin showing the manner of coupling the ends of two of the skylights of FIG. 11 and attaching to the purlin.
Figure 20:
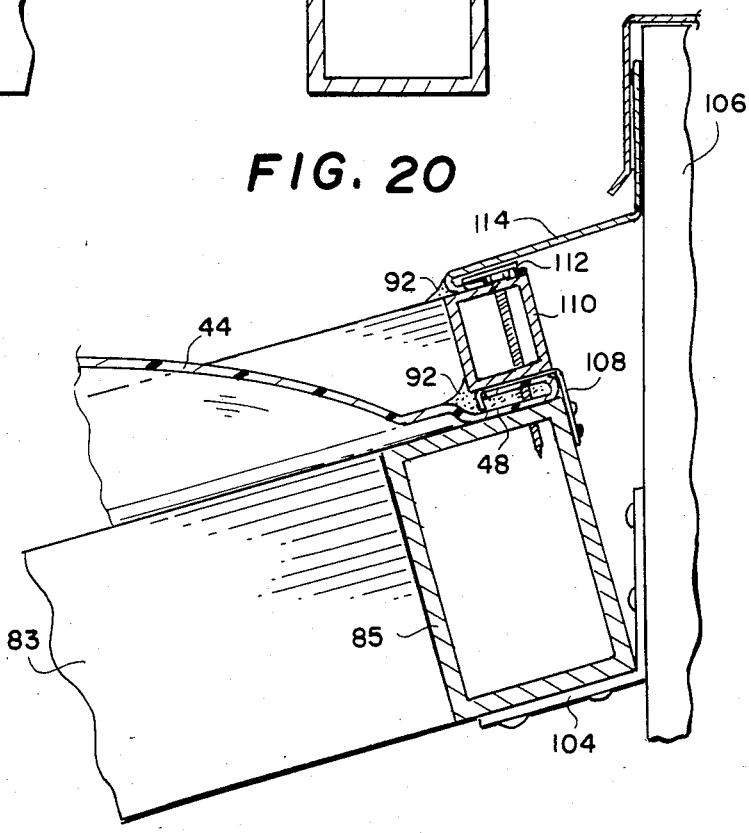
FIG. 20 is a cross sectional view of the rear perimeter rafter of the sunroof of FIG. 12 showing the attachment to a building.

Along the front perimeter rafter 85, the lower folded edge 46 of skylight 40 is attached thereto as shown in the cross-sectional view 17—17 of FIG. 17. Front rafter flashing 87 runs the length of rafter 85 and is attached thereto by screws 91. Flashing 87 has its upper edge folded over on itself to engage the folded portion 46 of skylight 40. Sealant 92 is provided to insure a leakproof joint. The manner in which the upper and lower edges of two skylights 40 are joined is indicated in FIG. 18 through cross-section 18—18. Lower edge 48 of the lower skylight is interlocked with upper edge 46 of the upper skylight. A plurality of C-clips 48 is installed along purlin 100 and coupled into the joint formed between edges 46 and 48 to secure the joint to the purlin. Sealant 92 is applied to prevent leakage. A typical joint between the skyroof and a building 106 is shown in cross-sectional view 20—20 in FIG. 20. The rafter assembly 83 and 85 is attached to a hangar bracket 104 which is fastened to wall 106. The upper edge 48 of skylight 44 is held against rear perimeter rafter 85 by clips 108. A closure channel 110 is fastened by suitable screws to rafter 85. A plurality of Z-clips 112 along the top of channel 110 is used to hold flashing 114 in place. The assembly is sealed with sealant 92.

It will be understood that in the figures, the thicknesses of the materials and the spacing therebetween are somewhat exaggerated for clarity. In actual use, the interlocking joints are formed to interlock tightly with a minimum of space between the materials forming the joints. Prior to joining the interlocking edges, sealant is applied to fill any voids.

Although specific implementations and configurations of the skylights of the invention have been disclosed and described herein, the invention is not to be considered limited to such examples. Various modifications to the exemplary disclosures will be obvious to those of skill in the art and are considered to fall within the spirit and scope of the invention.

We claim:

1. A skylight molded from sheet plastic for installation in a metal roof formed from a plurality of metal roof panels, each of said metal panels having a pair of parallel upstanding metal edges with the top edges thereof folded inwardly at 90 degrees with means for joining such edges with adjacent abutting upstanding edges comprising:

an essentially rectangular first sheet of plastic having a pair of essentially parallel edges thereof folded upwardly to form a right angle with said sheet of plastic, each of said upwardly folded edges having a top edge thereof folded at an essentially 90 degree angle inward to match said upstanding seam edges of said metal roof panels in which said essentially parallel folded up edges are spaced apart a distance slightly less than the spacing of said upstanding seam edges of said metal standing seam roof panels at one end of said sheet of plastic and spaced apart a distance slightly greater than the spacing of said standing seam edges of said metal standing seam roof panels at the other end thereof; and a dome formed in and projecting upward from said sheet of plastic.

2. A skylight as recited in claim 1 which further comprises a sheet of plastic disposed below said dome and bonded to said first sheet of plastic to form a first insulating air space between said second sheet of plastic and said dome.

3. A skylight as recited in claim 2 which further comprises a third sheet of plastic having a downwardly projecting dome formed therein, said third sheet of plastic disposed below and bonded to said second sheet of plastic to form a second insulating air space between said third sheet of plastic and said second sheet of plastic.

4. A sheet plastic dome skylight installation for a pitched roof having roof shingles thereon comprising:

(a) roof sheathing having a rectangular opening therethrough, said opening having a pair of sloping edges, an upper horizontal edge, and a lower horizontal edge;

(b) a rectangular skylight formed from a rectangular sheet of plastic having (i) a first pair of parallel edges thereof folded upward to form a right angle with said sheet of plastic thereby producing a pair of standing seam edges, (ii) a pair of parallel flat flanges formed along a second pair of parallel edges of said rectangular sheet of plastic, (iii) a dome portion in the central portion of said sheet of plastic, and (iv) said skylight being disposed over and covering said opening with said standing seam edges disposed along said pair of sloping edges of said roof opening and attached to said roof sheathing and a first one of said flat flanges disposed along said upper horizontal edge of said opening and attached to said roof sheathing and a second one of said flat flanges disposed along said lower horizontal edge of said opening and attached to said roof sheathing over a row of said roof shingles;

(c) a plurality of anchor clips attached along the sloping edges of said roof sheathing adjacent said opening and abutting said standing seam edges of said skylight;

(d) a plurality of step flashings having horizontal portions thereof attached to said roof sheathing and having vertical flanges thereof abutting with each of said standing seam edges of said skylight and said anchor clips, said anchor clips attached to standing seams formed by said vertical flanges of said step flashings and said skylight standing seam edges;

(e) a first row of overlapping roof shingles disposed along each of said standing seams and covering said horizontal portions of said step flashings;

(f) a second row of overlapping roof shingles disposed along and covering said first one of said flat flanges of said skylight; and (g) a batten disposed over each of said standing seams.

5. The skylight as recited in claim 4 in which the corner of an upper end of each of said standing seams formed by said standing seam edges and said step flashing flanges is cut off at an angle and which further comprises a shroud formed to match said cutoff ends, said shroud disposed over said cutoff ends and attached to said roof sheathing prior to disposition of said roof shingles over said flat flange.

6. A sunroof comprising:

at least two longitudinal rafters;

a plurality of purlins arranged at right angles to said rafters to define at least two essentially rectangular openings;

at least two rectangular plastic skylights having the dimensions of said rectangular openings and having a dome, a first pair of parallel edges of said skylights folded upward to form a right angle thereby forming a pair of standing seam edges, and a second pair of parallel edges, one edge thereof folded over and back on itself to form a first narrow U-shaped edge and the other edge thereof folded under and back on itself to form a second narrow U-shaped edge such that said first U-shaped edge of one of said skylights will snugly interlock with said second U-shaped edge of the other of said skylights;

a plurality of anchor clips attached to said rafters and a plurality of C-clips attached to said purlins; and said plastic skylights disposed over and covering said rectangular openings with said standing seam edges disposed along said rafters and said anchor clips engaging said standing seam edges, and said U-shaped edges disposed along said purlins with a first of said U-shaped edges of one of said skylights snugly interlocked with a second of said U-shaped edges of another of said skylights to form a joint, said C-clips coupled into each of said U-shaped edges.

7. The sunroof as defined in claim 6 in which a sealant is disposed along and between said skylights and said rafters, between said interlocked U-shaped edges, and between said joints and said purlins.

8. The sunroof as defined in claim 7 in which:

said plurality of rafters includes at least three longitudinal rafters and said plurality of purlins are arranged to define at least four essentially rectangular openings;

adjacent ones of said standing seam edges of said skylights are abutted to form a standing seam therebetween along one of said longitudinal rafters having a plurality of said anchor clips engaging said standing seam; and a batten is disposed over each of said standing seams.

9. A skylight formed from plastic sheet for a sun roof comprising:

an essentially rectangular sheet of plastic having a first pair of parallel edges thereof folded upward to form a right angle with said sheet of plastic to form a pair of standing seam edges;

a second pair of parallel edges of said sheet of plastic, one edge thereof folded over and back on itself to form a first narrow U-shaped edge and the other edge thereof folded under and back on itself to form a second narrow U-shaped edge such that said first U-shaped edge of one said skylight will snugly interlock with said second U-shaped edge of another of said skylight; and a dome formed in and projecting upward from said sheet of plastic.

* * * * *